United States Patent [19]

Plaessmann

[11] Patent Number: 4,583,899

[45] Date of Patent: Apr. 22, 1986

[54] APPARATUS FOR INSERTING POURING SPOUTS INTO CONTAINER TOPS

[75] Inventor: Frederick A. Plaessmann, Edison, N.J.

[73] Assignee: Seal Spout Corporation, Liberty Corner, N.J.

[21] Appl. No.: 586,862

[22] Filed: Mar. 6, 1984

[51] Int. Cl.[4] ..... B21D 51/00

[52] U.S. Cl. ..... 413/53; 413/22

[58] Field of Search ..... 413/22, 53

[56] References Cited

U.S. PATENT DOCUMENTS 2,061,575 11/1936 Hothersall ..... 413/53

2,972,184 2/1961 Andrew ..... 413/22

4,364,255 12/1982 Byrd ..... 72/345

*Primary Examiner*—Leon Gilden

*Attorney, Agent, or Firm*—Edward R. Weingram

[57] ABSTRACT

A machine for inserting pouring spouts in caps, provides for feeding the caps to an indexing work table through an inlet apparatus which coordinates the position of the caps with the position of the indexing table. Mounting apparatus is provided to mount the caps on the indexing work table, which table moves the caps in a coordinated sequence to work positions where the pouring spouts are inserted in the caps. The indexing work table then moves the caps to an outlet position where ejecting apparatus removes the caps with the inserted spouts from the indexing work table, the pouring spouts on the caps are placed in the desired position and the caps are properly oriented as the caps leave the area of the spout inserting machine. A pneumatic assembly provides for the delivery of the container tops to the indexing table and for transfer of the container tops with the inserted spouts away from the indexing work table. The indexing table is coordinated with the mounting apparatus, ejecting apparatus, and the inserting apparatus by a power transmission system powered by an indexing drive.

5 Claims, 14 Drawing Figures

5
5
106
170
102
186
3
110
166
54
20
56
56
2
41
2
80
50
121
142
52
136
144
130
146
152
48
40
116
46
126
120
118
46
112
3
114
122
42
44
44

APPARATUS FOR INSERTING POURING SPOUTS INTO CONTAINER TOPS

BACKGROUND OF THE INVENTION

1. Field of the Invention

This invention relates to machines for inserting pouring spouts into containers and more particularly to machines for inserting pouring spouts into the caps or tops of containers.

2. Description of the Prior Art

Machines for inserting spouts into containers have been known for a substanial period of time. Most of the better machines, however, place spouts on the sides of containers. It is a much more difficult task to place the spouts on the top of the container especially if the containers are round containers. Some of the problems associated with placing the spouts on the tops of containers and especially round containers are that it is necessary to coordinate the position of the spout with the closed container. This is easier to do if the container is a one-piece unit in which the top is folded to form the top of the container or if the container is rectangular in shape so that the spout can always be oriented on one particular wall of the container.

Additionally, if the spout is placed on the top of the container then the container is usually filled with its contents before placing the top of the container and this makes the handling of the containers much more difficult. Since the containers are filled with material rather than being empty, any possible tipping of a container will result in the spilling of material along the production line. Further, if the containers are filled prior to placing the top on the container then there must be sychronization between the delivery of the container tops which have pouring spouts inserted in them and the speed of the assembly line in which the containers are filled.

Examples of spout inserting machines are shown in U.S. Pat. Nos. 4,072,117, 3,690,223, 3,523,512, 3,385,248 and 3,381,645. U.S. Pat. No. 4,072,117 shows the device for placing spouts on the side of round containers, and shows the method by which the spouts are inserted into the container. This patent is incorporated herein by reference.

Other problems that have been encountered in attempting to provide apparatus to insert pouting spouts into the tops of containers have to do with the postioning of the container top during the insertion of the spout. The tops are relatively small and light and it is difficult to immobilize the tops during the insertion process. Also, if one or more tops become misaligned in the insertion process, it can have a snowballing effect on disrupting the tops or caps that are following in the path of delivery for insertion of the pouring spout.

Further, it has been found difficult to position the cap or orient the cap in the appropriate relationship to the container so that the cap will always be placed onto the container with the spout in the desired position. Also, it is often difficult to maintain the pouring spouts in the desired position with relation to the cap, namely in the open or closed position. Uniformity in this area is of utmost importance.

SUMMARY OF THE INVENTION

Accordingly, to deal with the problems which have existed, the present invention provides a machine for inserting pouring spouts in caps. Caps are fed to an indexing work table through an inlet apparatus which coordinates the position of the caps with the position of an indexing table. Mounting apparatus is provided to mount the caps on the indexing work table, which table moves the caps in a coordinated sequence to work positions where the pouring spouts are inserted in the caps. The indexing work table then moves the caps to an ejecting position where ejecting apparatus removes the caps with installed pouring spouts from the indexing work table. The pouring spouts on the caps are placed in the desired position and the caps are properly oriented as the caps leave the area of the spout inserting machine. A pneumatic assembly provides for the delivery of the container tops to the indexing table and for transfer of the container tops with the installed spouts away from the indexing work table. The indexing table is coordinated with the mounting apparatus, ejecting apparatus, and the inserting apparatus by a power transmission system which includes an indexing gear box.

Accordingly, it is an object of the present invention to provide apparatus for inserting pouring spouts in the tops of containers which can acurately position the pouring spout in the top of the container.

Another object of the present invention is to provide apparatus for inserting pouring spouts in the tops of containers which positions the spout with relation to the top.

A further object of the present invention is to provide apparatus for inserting pouring spouts in the tops of containers which positions the pouring spout in the open or closed position.

Still another object of the present invention is to provide apparatus for inserting pouring spouts in the tops of containers which enables pouring spouts to be placed on the top of containers which are separated from the containers.

A further object of the present invention is to provide apparatus for inserting pouring spouts in the tops of containers which provides a smooth feed of container tops to the work station where the pouring spouts will be inserted.

Yet another object of the present invention is to provide apparatus for inserting pouring spouts in the tops of containers which holds work pieces in proper position until ready for transportation by an indexing table through the various stages of the operation.

Still another object of the present invention is to provide apparatus for inserting pouring spouts in the tops of containers which prevents skewing or misalignment of work pieces at the inlet or outlet to the apparatus or during the insertion process.

A further object of the present invention is to provide apparatus for inserting pouring spouts in the tops of containers which prevents stacking up of tops as they move through the apparatus.

Yet another object of the present invention is to provide apparatus for inserting pouring spouts in the tops of containers which prevents skipping of tops by the apparatus.

Still another object of the present invention is to provide apparatus for inserting pouring spouts in the tops of containers which orients the caps once the spouts are inserted so as to be in a specific attitude when leaving the apparatus.

A further object of the present invention is to provide apparatus for inserting pouring spouts in the tops of containers which provides a sequential feed of work pieces.

Yet another object of the present invention is to provide apparatus for inserting pouring spouts in the tops of containers which provides numerous operations that are easily coordinated to prevent malfunctioning.

Still another object of the present invention is to provide apparatus for inserting pouring spouts in the tops of containers which doesn't require complex delivery or removal apparatus such as conveyor belts.

A further object of the present invention is to provide apparatus for inserting pouring spouts in the tops of containers which has multiple operating powered from a single drive means.

Yet another object of the present invention is to provide apparatus for inserting pouring spounts in the tops of containers which has multiple operating stations which are fed from a single inlet and feed a single outlet.

Still another object of the present invention is to provide apparatus for inserting pouring spouts in the tops of containers which has means to easily adjust the speed of the apparatus to coordinate it with varying manufacturing processes.

A further object of the present invention is to provide apparatus for inserting pouring spouts in the tops of containers which is relatively simple in construction.

Yet another object of the present invention is to provide apparatus for inserting pouring spouts in the tops of containers which is relatively durable in operation.

Still another object of the present invention is to provide apparatus for inserting pouring spouts in the tops of containers which is extremely reliable during its operation and in the accuracy of the work that it performs.

Other objects and advantages will become apparent from the following description taken in conjunction with the accompanying drawings.

DESCRIPTION OF A PREFERRED EMBODIMENT

Figure 1:
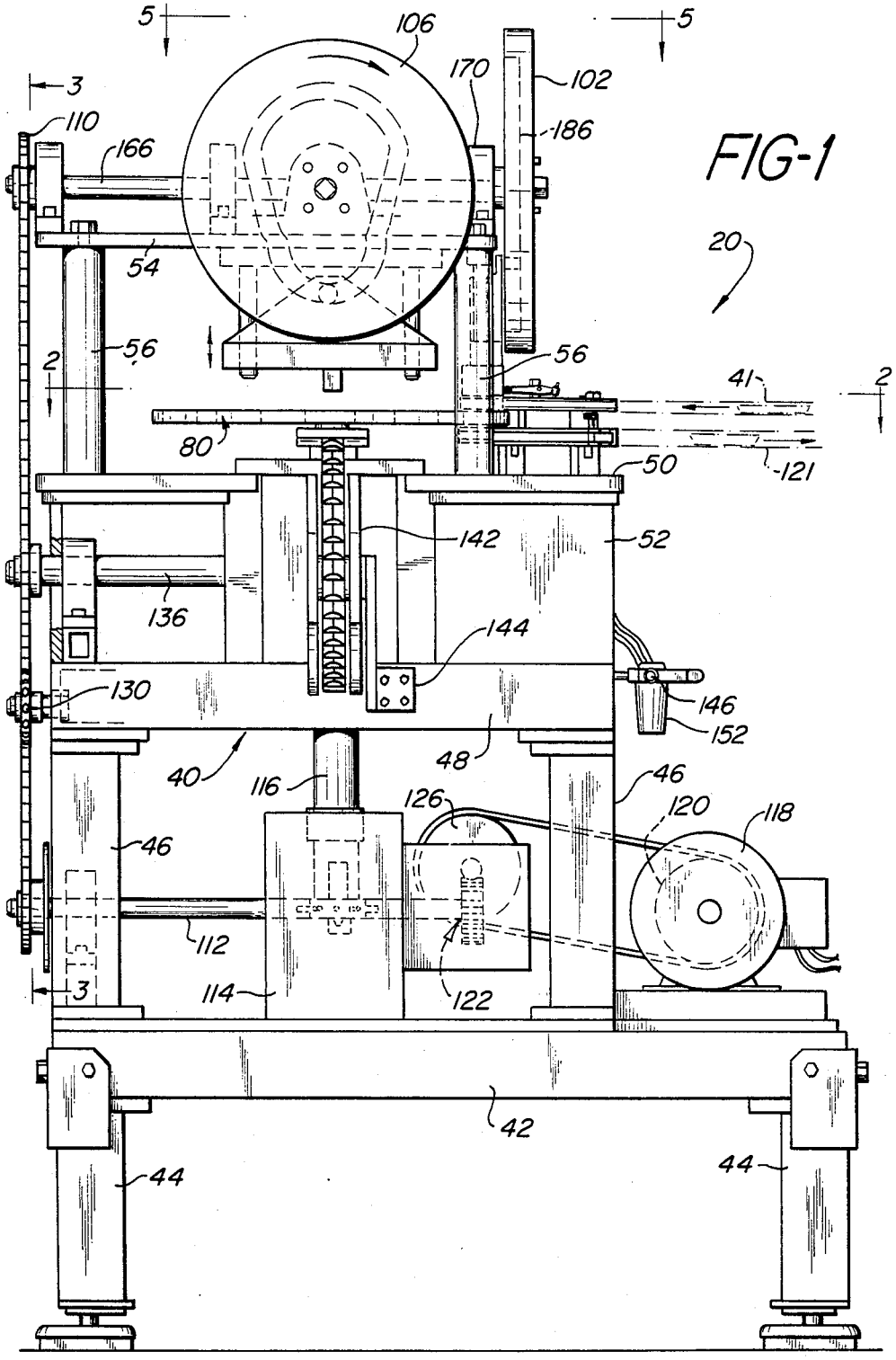
FIG. 1 is a front elevation, with certain parts shown in phantom, of a machine built in accordance with the teachings of the present invention.

Referring to the Figures, FIG. 1 shows the spout inserting machine generally indicating as 20, having a frame generally indicated at 40, which is mounted an upper platform to which leads an inlet apparatus which feeds a series of blank or empty circular caps or tops to an indexing table which then moves the caps inserted in the table to work positions where pouring spouts are placed in the caps. The table then continues its' movement to bring the caps, which have had spouts inserted, to the outlet station of the apparatus. The indexing table and the apparatus to mount and eject the caps, and the apparatus to insert the spouts into the caps, are all powered by means of a drive which is connected by appropriate power transmission means to the various components. A complimentary pneumatic system is used to transport the caps along the inlet to the machine and along the outlet from the machine.

Referring to FIGS. 1 through 4, the frame generally indicated at 40 consists of a lower platform 42 supported by bottom legs 44, which lower platform supports lower legs 46 that support a mid-platform 48, which in turn, support an upper platform 50 by means of upper legs 52 which rest on the mid-platform. Upper platform 50 supports a pedestal 54 by means of four pedastel legs 56. An indexing table, generally indicated at 80, is mounted above the upper platform and is in communication with an inlet ramp 41 and an exit ramp 121. Mounted on pedestal 54 are a series of large flywheel-cam wheels, namely an inlet/outlet cam 102, a first station cam 104, and a second station cam 106. The inlet/outlet cam and the other rotating cams are driven by means of a cam drive sprocket 108 connected by means of a drive timing chain 110 to the back side of the input shaft 112 of an indexing gearbox 114. The indexing gearbox has sequenced output shaft 116 which is connected to the indexing table 80 to drive the indexing table 80 in a sequenced manner for purposes to be described later.

A drive motor 118 having an output shaft which turns a drive pulley 120 is connected by a belt to a speed reducer 122, which symbolically is shown as having a shaft which is then connected to an input shaft 124 of the indexing gear box after being connected by the speed reducer pulley 126. A drive sprocket 128 is connected to the constant speed back side of the indexing gear box input shaft 112. Drive sprocket drives chain 110 through two idler sprockets, 130 and 132 respectively, and the chain then engages spout drive sprocket 134, which is connected to a spout drive shaft 136 which is connected by means of a beveled gear arrangement, generally indicated at 138, to a series of shafts and cams which are used to draw in the blank pouring spouts 140 to the work stations. The blank spouts are kept on a reel 142 mounted to the mid-platform 48 by means of a bracket 144, as is shown in FIG. 2.

Figure 2:
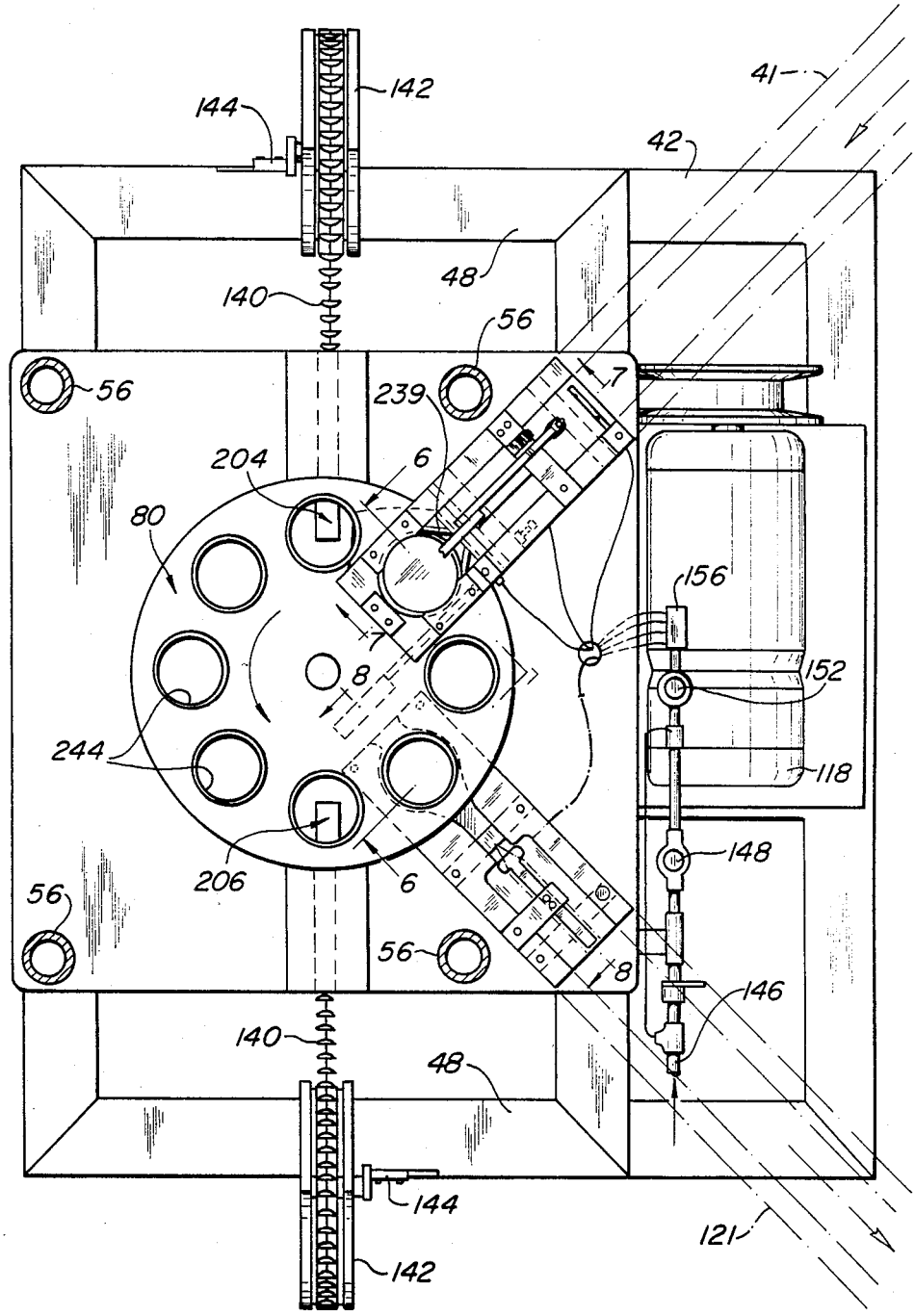
FIG. 2 is a top plan view taken along the lines 2—2 of FIG. 1.
Figure 3:
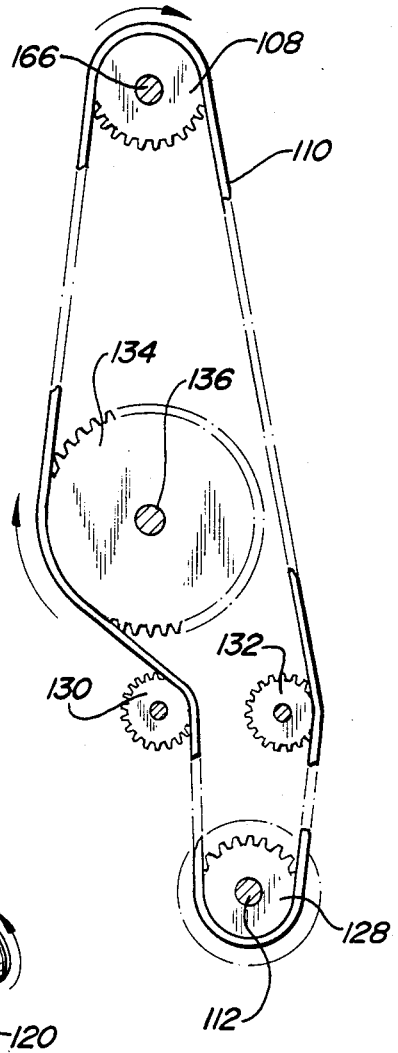
FIG. 3 is a view of the drive mechanism gearing taken along lines 3—3 of FIG. 1.
Figure 4:
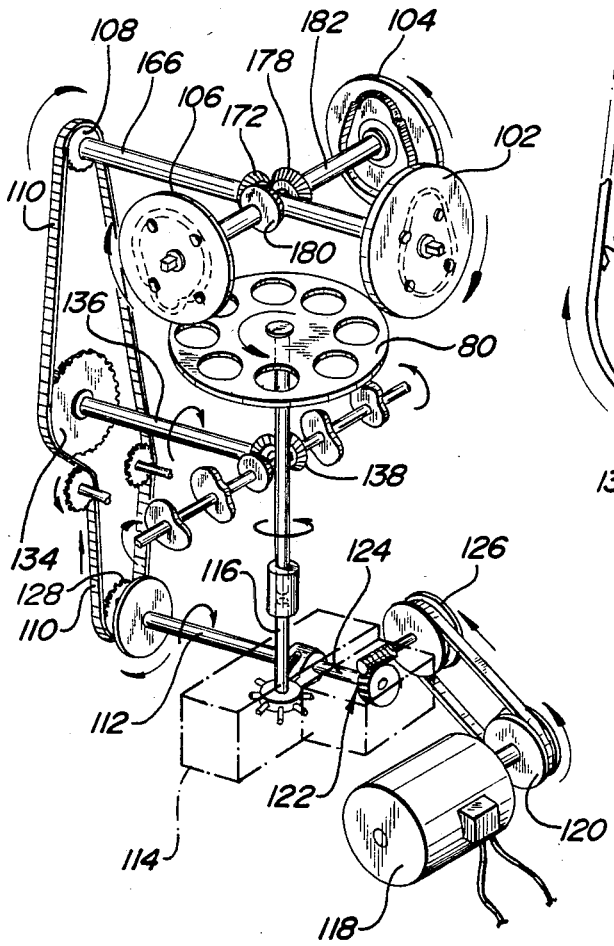
FIG. 4 is a schematic view showing the power transmission system for the machine showing in FIG. 1

Referring to FIG. 2, an air supply having an inlet 146 has a standard filter 148, and air regulator 152, which lead into a manifold 156 from which an inlet jet 158, a mounting jet 160, and an ejection jet 162, and outlet jet 164 branch off.

Figure 5:
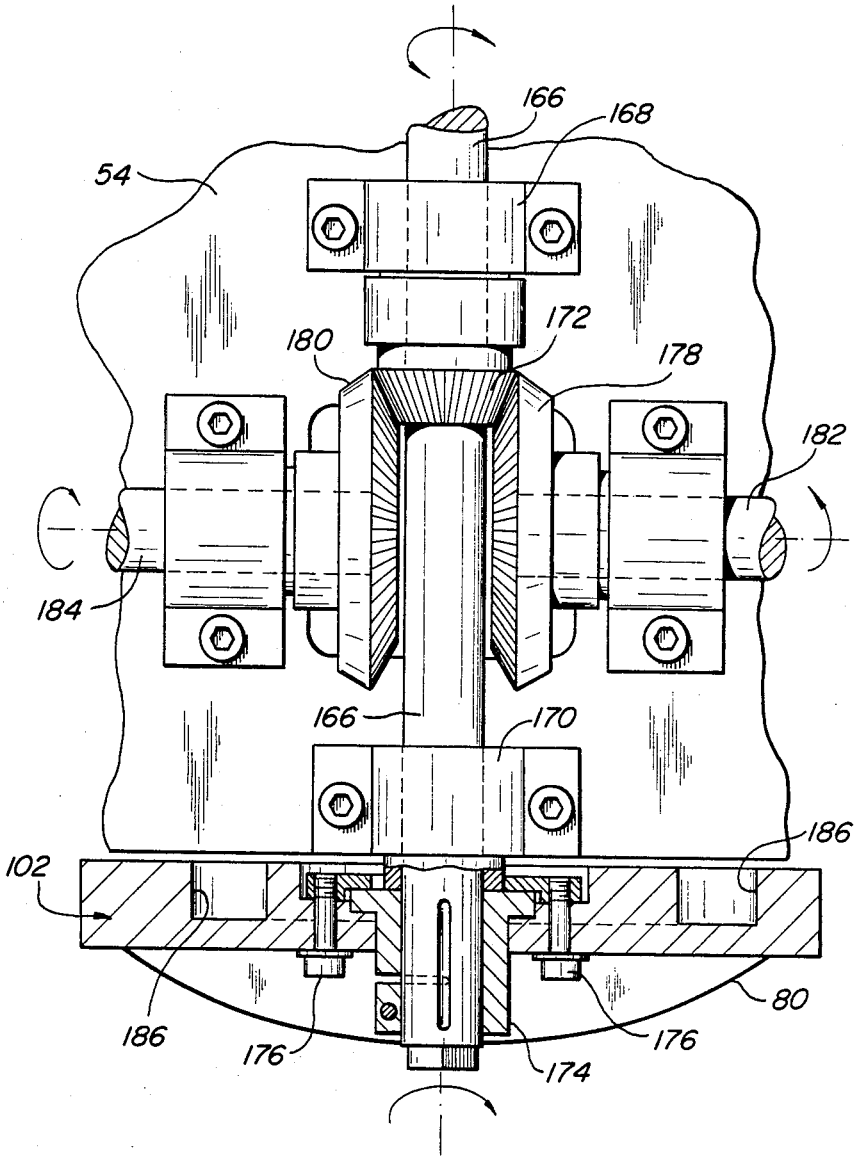
FIG. 5 is a partial top plan view taken along lines 5—5 of FIG. 1.

Referring to FIG. 5, we see the drive and gearing arrangement for the flywheel-cam-wheel assembly. The cam drive sprocket 108 drives cam drive shaft 166, which is secured to the pedestal 54 by appropriate bearings and bearing housings 168 and 170. Drive shaft 166 drives a beveled drive gear 172 and continues on to drive the inlet/outlet cam 102. Inlet/outlet cam 102 is fastened to main cam drive shaft 166 by means of a a hub and clamping ring arrangement. The hub, which is now 174, is secured to the shaft by means of a clamp screw not shown, and the plurality of retaining nuts connect the front of inlet/outlet cam 102 to a clamp ring. The retaining nuts, therefore, hold the inlet/outlet cam (and the other cams in a similar manner) to the clamp ring by a frictional fit. Tightening of the retaining nuts 176 will therefore hold the cam fixed with relation to the angular position of the shaft. However, for timing purposes should it be desired to vary the position of the cam with relation to the shaft, the retaining nuts 176 can be loosened so as to allow the inlet/outlet cam 102 to slide relative to the shaft. The clamp ring will also slide with the nuts since it is held on merely by a frictional fit to the back of the HUB 174. Once the proper position of the cam has been set, then tightening up of the retaining nuts 176 will again fix the cam in the proper attitude or relationship to the shaft for co-ordinating the sequenced operations of the apparatus.

Beveled drive gear 172 drives beveled driven gears, 178 and 180 respectively, which drive the first station drive shaft 182 and the second station drive shaft 184. The bevel driven gears for stations one and two are twice as large as the beveled drive gear for the main cam drive shaft, and, therefore, the station one and two drive shafts will rotate at a speed of half the speed of the main inlet/outlet drive shaft. As can be seen in FIG. 5, a cam groove 186 is formed in the back of inlet/outlet cam 102 and a similar groove is formed in the station one and station two cams.

Figure 6:
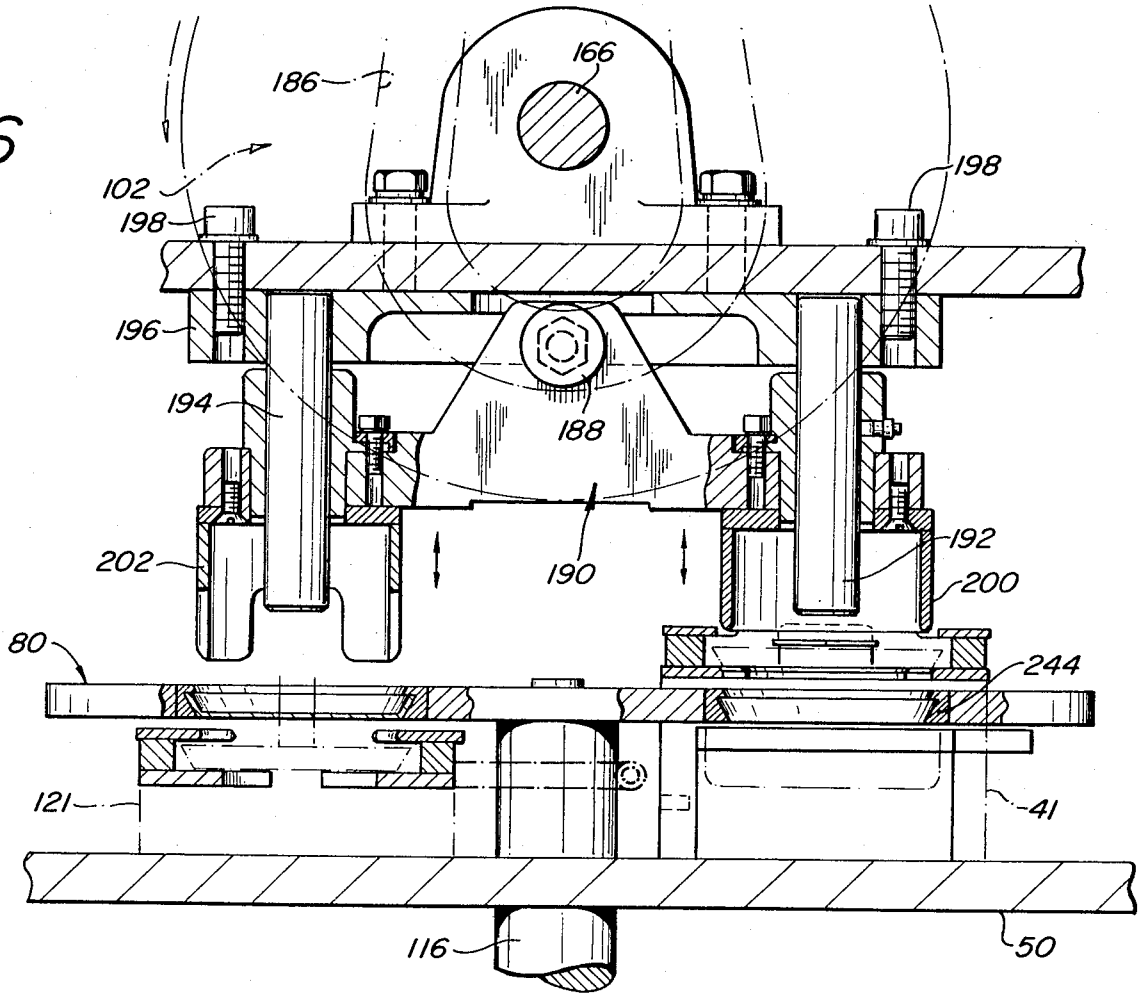
FIG. 6 is a partial elevation taken along lines 6—6 of FIG. 2, showing the mechanism for driving the insertion and removal members of the machine.

Referring to FIG. 6, we see in phantom the inlet/outlet cam 102 and the cam groove 186, shown in phantom, and we see a cam follower 188 mounted on an elevator 190, which will be raised and lowered along mounting and ejecting guide rods 192 and 194 respectively, as the cam follower 188 moves the elevator 190. The elevator will move up and down the mounting guide rods 192 and ejecting guide rods 194 as the cam follower 188 moves up and down in the cam groove 186. The guide rods are mounted in a guide rod support 196 fastened to the pedestal by means of fastening bolts 198.

As shown in FIG. 6, a mounting plunger 200, and an ejecting plunger 202, ride on mounting and ejecting guide rods 192 and 194 respectively. As seen most clearly in FIGS. 1*a* and 2, the mounting plunger acts to transfer blank caps from the inlet ramp 41 to the indexing table 80, which in turn, will carry them to work stations one and two, indicated at 204 and 206 respectively, and then to the exit ramp 121.

As mentioned previously, because of the difference in size between the beveled drive gear 172 and the beveled driven gears for work stations one and two, the elevators at work stations one and two will operate at half the speed of the inlet/outlet elevator 190 carrying the mounting and ejecting plungers. Additionally, the sequencing and gearing operation enables a single inlet ramp and mounting mechanism to mount enough caps on the indexing table to provide work for two spout inserting operations. Similarly, the ejection operation, including the injection plunger, works twice as fast as the spout inserting operations, and therefore, there is a synchronized harmony between the mounting and ejecting operations and the spout inserting operations.

The apparatus for inserting the spout into the cap is essentially the same as that shown in U.S. Pat. No. 4,072,117, issued Feb. 7, 1978 to Frederick Plaessmann, which is incorporated herein by reference. The major difference is that the orientation of the spout inserting apparatus is varied in order to provide for the horizontal insertion of the spout versus the vertical insertion of the spout, as was previously done in the referenced patent.

Figure 7:
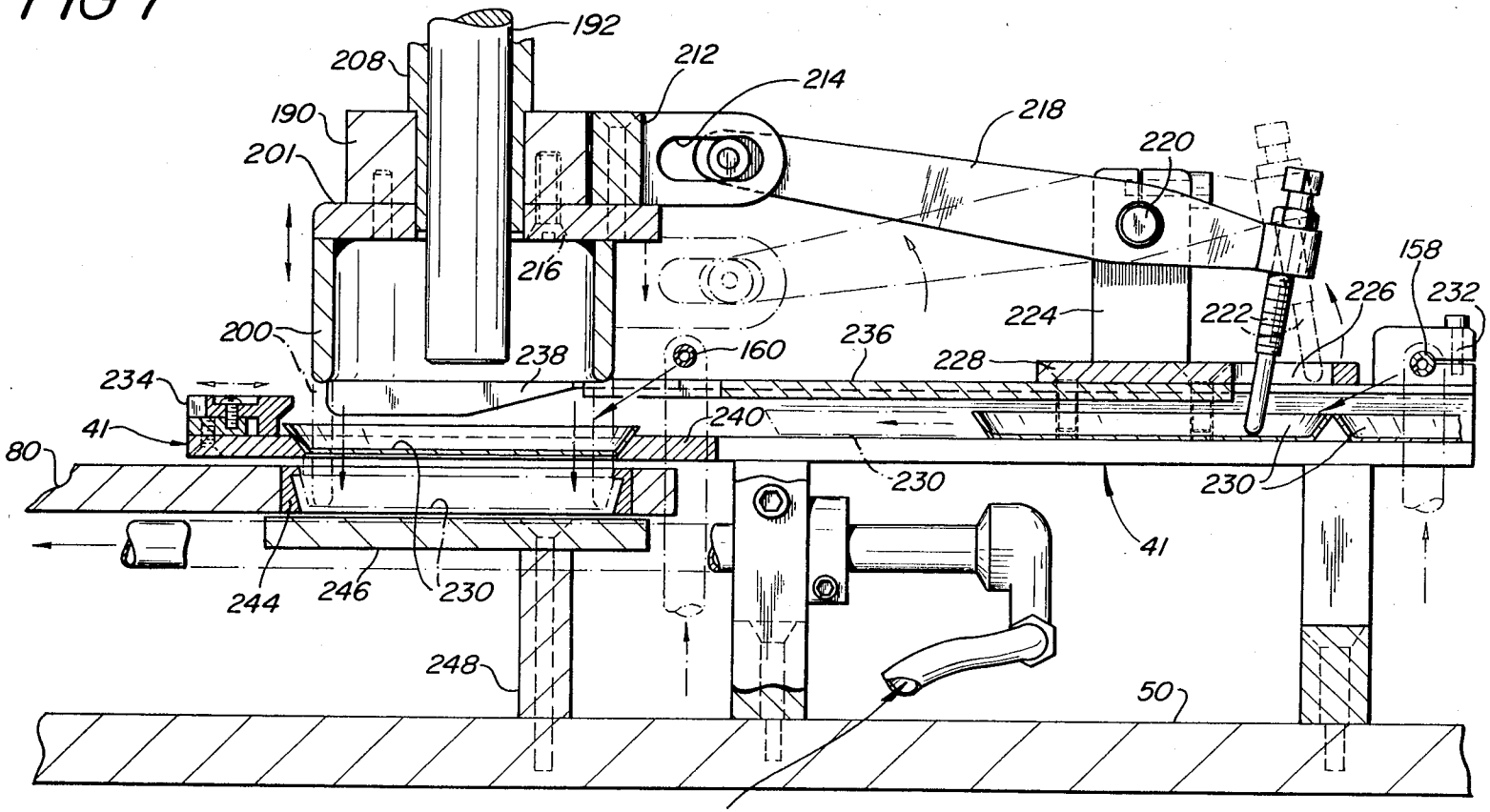
FIG. 7 is a side elevation, partially in section, taken along lines 7—7 of FIG. 2, showing the intake portion of the machine.

Referring now to FIG. 7, we see the apparatus of the inlet and mounting stage of the machine. The mounting plunger 200 is mounted on the inlet/outlet elevator 190, and rides up and down on a mounting guide rod 192. A bushing 208 is connected to the top of elevator 190, and attached to the plunger 200 is an ear 212 having a slot 214. The plunger 200 is connected to the elevator 190 by means of a mounting bolt 216 which passes through upper plate 201 of the plunger and threads into elevator 190. The ear 212 is connected to upper plate 201 by a cap screw extending down into the upper plate. The ear has a groove 214 at one end and is bent so that the other end of it forms the part through which the cap screw extends down to fasten it to the upper plate 201 of the mounting plunger. An arm 218, is slidably connected at one end to ear slot 214 and is pivoted about pivot 220 to hold a timing finger 222 at the far end of the rod.

Timing finger 222 will, therefore, move up and down in opposition to the movement of the mounting plunger 200, because of the central pivoting arrangement by which arm 218 mounted. The pivot 220 is supported by pivot support 224 and the mounting finger itself can be adjusted since it is threadably mounted within the end of timing arm 218. The end of timing finger 222 passes through slot 226 in finger guide or rail 228 to enable the mounting finger to come very close to the bottom surface of inlet ramp 41 in order that the timing finger can restrain the empty caps 230 which are in the inlet ramp.

Figure 1A:
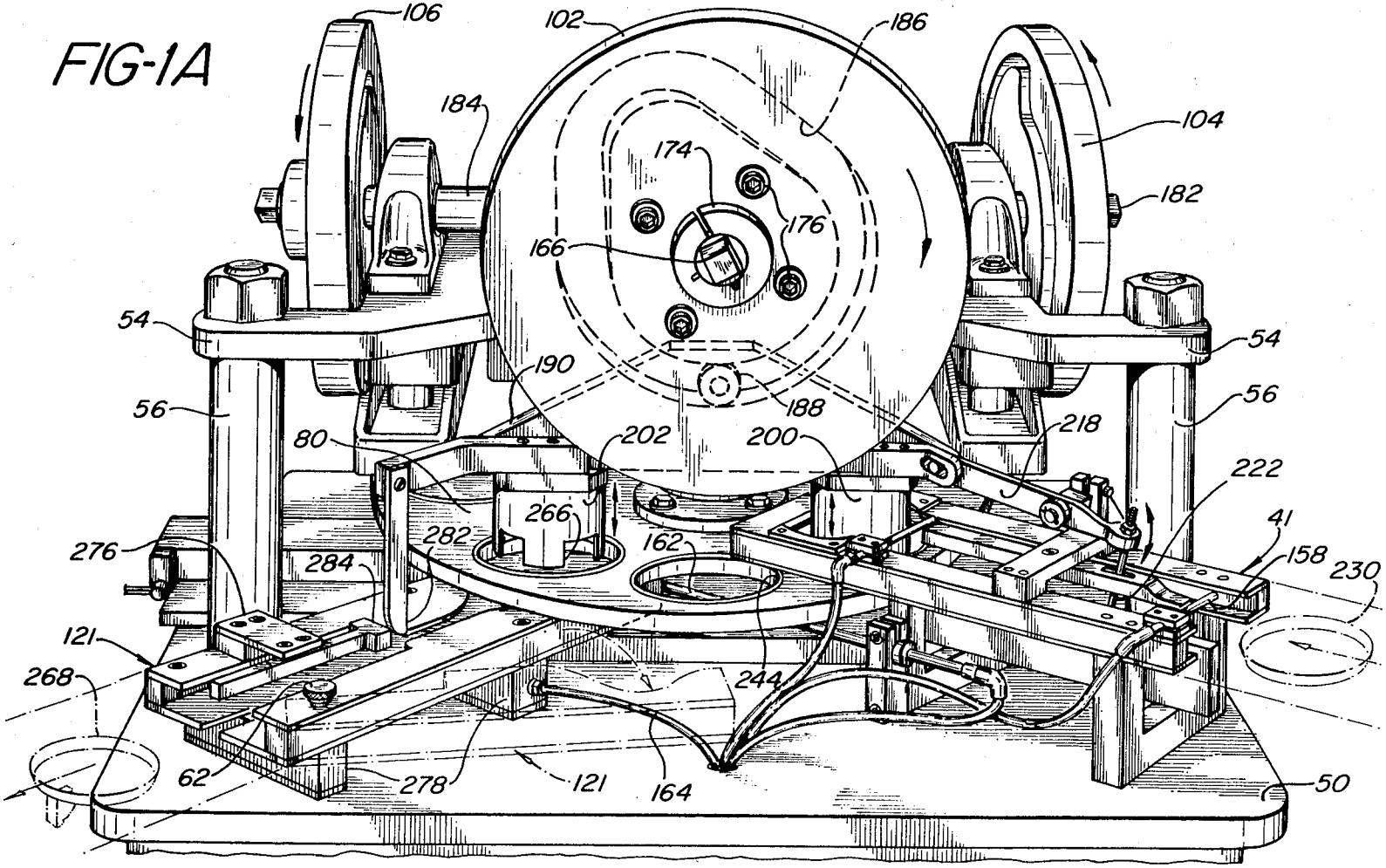
FIG. 1A is a perspective view of the upper portion of the apparatus showing the inlet and outlet stations.

As shown most clearly in FIG. 1*a* and FIG. 7, inlet ramp 41 has a bottom surface on which the empty caps 230 will be directed by means of the inlet jet 158 mounted in a holder 232. The jet will urge the empty cap towards the mounting plunger. However, as long as the mounting plunger is in the upper position, the timing finger will hold the cap because of either the pressure of the timing finger against the bottom of the cap, or as more probably the case, the contact of the timing finger with the raised side wall of the cap. Once the mounting plunger 200 is moved down because of the downward movement of mounting/ejecting elevator 190, the timing finger will be raised to allow the empty cap to be driven by the force of inlet jet 158 until it will come in contact with the vertical side wall of the mounting plunger, which is now in its lower position.

When the mounting plunger raises to the upper position, the empty cap 230 will then be urged toward the backstop 234 connected to the end of the inlet ramp 41. Additionally, the upper surface 236 of the inlet ramp has a camming surface 238, or a positioning cam, that will force the empty cap downward as it moves toward backstop 234 into the receptacle in the waiting plate 240, which is the end of the inlet ramp.

Therefore, as the mounting plunger 200 has been raised, the empty cap 230 has been urged to move to the end of the inlet ramp, and has been forced by positioning cam surface 238, of the upper surface 236 of the inlet ramp, downward into the receptacle in the waiting plate 240. Backstop 234 prevents the cap from moving out of registration with the path of travel for the mounting plunger.

Backstop 234 has a ramp-like tapered head mounted on a projecting stem. The head is secured to the stem by means of a flathead screw or a set screw which passes through a slot in the stem. Therefore, by loosening the screw the backstop can be moved toward the pivot arm or away from the pivot arm as desired to accommodate caps of different diameter.

Note that the arrangement of the timing finger with the position of the mounting plunger and the waiting plate, provides a system which insures an accurate supply, in sequential order, of empty caps which are to be processed. As the mounting plunger desends, the next cap in sequence will be moved to rest against the side of the mounting plunger and air from the inlet jet will push the next cap against the cap that is resting aginst the side of the mounting plunger. When mounting plunger 200 rises, mounting jet 160 will urge the waiting empty cap into the receptacle in the waiting plate and hold the cap in stationary position, while the cap behind the cap in the waiting plate is held in an on-call position by the timing finger 222.

Because of the sequenced operation of the inlet/outlet elevator and the indexing table, the mounting plunger 200 will not descend to force the empty cap from the receptacle of the waiting plate into the receptacle of the indexing table, shown as 244, until the indexing table has moved into position and is in a stationary position, ready to receive the empty cap.

To insure that the blank or empty caps 230 are positioned within the receptacle 244 of indexing table 80 in such a manner that there is no chance of them being misaligned, a stabilizing plate 246 is fixedly mounted to upper platform 50 by means of a support 248. The stabilizing plate has a flat surface parallel to, and very close to, the bottom of the indexing table so that there is no possibility for the cap to be misaligned by extending down below the bottom of the indexing table 80.

The waiting plate, backstop, stabilizing plate, and the cap receiver, in the indexing plate, together with the positioning cam surface in inlet ramp, all tend to insure that caps to be processed are securely and properly placed in the indexing table. If desired, stripping fingers 239, as shown in FIG. 2, can be provided to the inlet ramp adjacent the mounting plunger to prevent misalignment of any inlet caps which have not yet traveled to the waiting plate and been positioned in the receptacle of the waiting plate, but which are waiting to proceed to that position. The stripping finger prevents these caps, which often are abutting the mounting plunger, from being drawn upward in the inlet ramp as the mounting plunger itself rises after inserting a cap into the indexing table.

The reason that the empty cap can interfere with the mounting plunger as it rises, is that when the mounting plunger travels down to force the cap from the waiting plate into the receptacle in the indexing table, the timing finger will be raised and, therefore, the air jet will push the cap up to an abutting position with the lowered mounting plunger. When the mounting plunger rises the timing finger will again be lowered to hold the next cap in a waiting position. However, in the meantime, as the mounting plunger starts to rise, the next cap has been freed and is resting against the mounting plunger and is being urged against the mounting plunger by the jet.

The stripping fingers prevent the cap from being lifted off the inlet ramp into a cocked position where it might not be able to co-act properly in coordination with the positioning cam 238. The stripping fingers 239, therefore, keep the cap in a proper position with the top of the cap against the bottom of the inlet ramp so that the bottom or ends of the cap side walls will clear the bottom of the inlet plunger and allow the cap to slide into position in the waiting table where it can then be forced out onto the indexing ramp.

Figure 12:
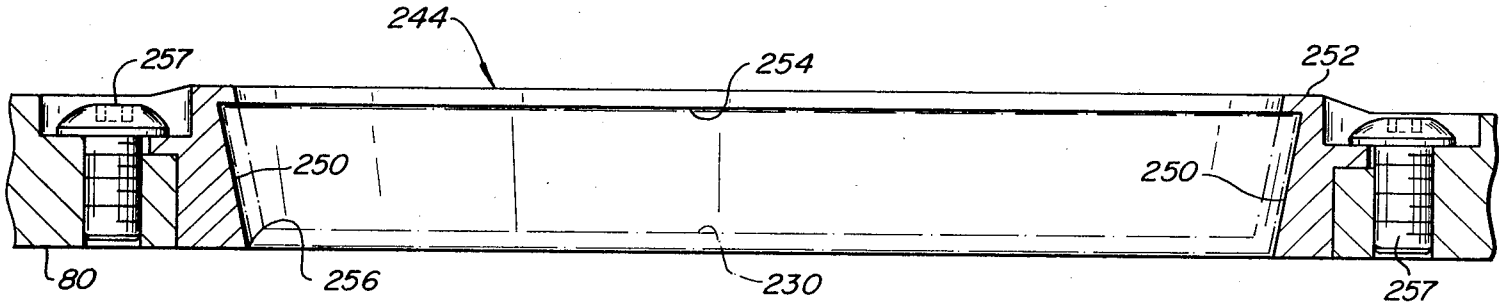
FIG. 12 is an enlarged partial view in section of the receiver for the caps to be processed.
Figure 13:
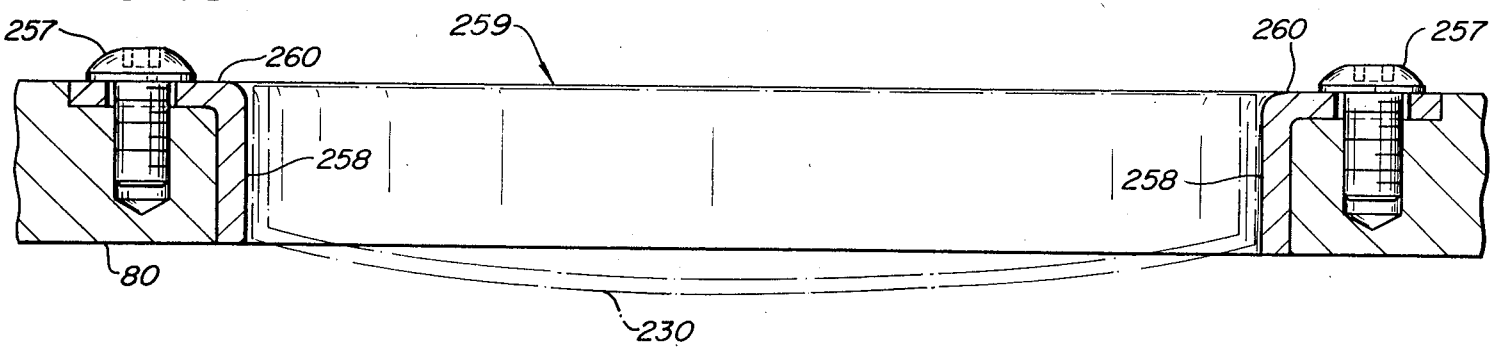
FIG. 13 is an enlarged partial view in section of another embodiment of the receiver for the caps to be processed.

Referring to FIGS. 12 and 13, there are two different configurations that can be used for the receptacles of the indexing table to hold the caps. as shown in FIG. 7, the receptacle 244 of the indexing table 80 is also shown in FIG. 12. The receptacle is a one piece unit adapted to fit into an aperture in the indexing table. It has tapered side walls 250 and an overhand in the upper diameter 252, so that the diameter of the overhang is smaller than the maximum diameter 254. The retaining overhang diameter 252 is also larger than the diameter 256 at the bottom of the receptacle or cap receiver, so that the side walls of the cap have the ability to expand, and therefore, relax the tension on the flat or top part of the cap. This prevents the top of the cap from bowing out and tending to drop beneath the bottom of the index table, which can somewhat complicate the spout inserting operation. The entire receptacle for the cap is connected to the indexing table by means of retaining screws 257.

As shown in FIG. 13, another type of cap receptacle or receiver for the indexing table can be provided. The cap receiver, generally indicated at 259, has parallel side walls 258 and is mounted in the receptacle for the indexing table by means of shoulders 260.

As shown in FIG. 13 in phantom, the top of the cap will tend to bow out because of the cylindrical diameter of the walls which tend to put a stress on the cap. Additionally, the side walls of the cap in the cylindrical walls 258 would tend to wrinkle in order to conform from an initially tapered configuration to the rigid cylindrical configuration. The wrinkling is necessry to take up the additional material as the bottom ends of the cap are compressed.

Note that the taper on the cap receiver or the crimping of the sides of the cap in the cylindrical cap receiver will maintain orientation of the cap on the indexing table as the indexing table moves around. It is important that the cap be firmly held with relation to the indexing table as it moves through the various stations of the operation. By having a taper in the cap receiver, with an overhanging lip, the natural tendencies of relaxation of the sides of the cap will tend to cause the cap to be held snug against the side of the tapered walls of the cap receiver. Therefore, there will be no tendency for the cap to rotate in the indexing table.

Where you have cylindrical or parallel side walls then there is merely the frictional force of the cap against the side walls which will hold the cap and prevent it from rotating within the cap receiver as the indexing table rotates.

Either cap receptacle shown in FIG. 12 or 13 can be varied in size to accommodate caps of different diameters and can also be used to accommodate caps which are not necessarily circular in shape. So for example, the apparatus is equally adaptable for caps which are of rectangular or oval shape.

The ejection apparatus and exiting mechanism for the caps, after they have had pouring spouts inserted, is shown most clearly in FIGS. 8 through 11, and also in FIG. 1*a*.

As shown in FIG. 1*a*, the outlet ramp or exit ramp includes a swivel arrangement for the right-hand portion of the upper surface of the exit ramp. By merely twisting down on the hand knob 62 you will tighten a cap screw, which is also the pivot for the entire upper section. A pin extends up from exit ramp support 278 so that when you back off on the hand knob 62, the entire right upper section of the exit ramp can be lifted off of the pin and can swing away, as shown in phantom, to allow access to the exit ramp to unjam any caps that are located in the exit ramp upstream of the exit guide or cap opening finger.

Figure 8:
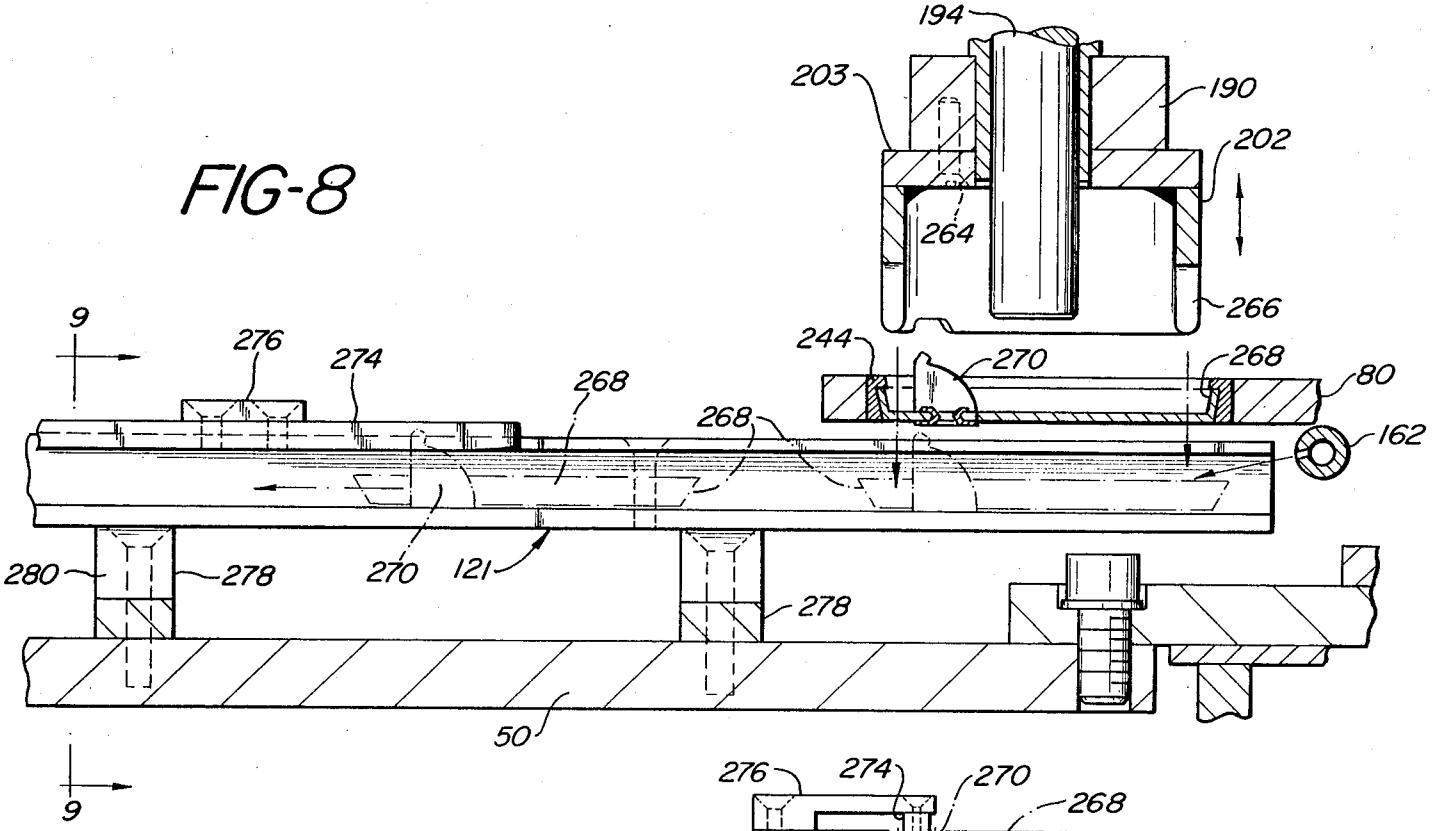
FIG. 8 is a side elevation, partially in section, taken along lines 8—8 of FIG. 2, showing the outlet portion of the machine.
Figure 9:
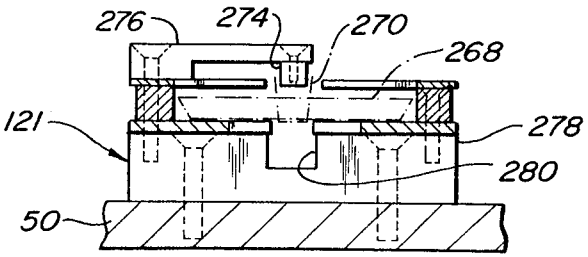
FIG. 9 is a partial front elevation, partially in section, taken along lines 9—9 of FIG. 8.

With respect to FIG. 8, the configuration shown is intended for use when it is desired to have the caps exit the apparatus with the pouring spout in the closed position. As shown in FIGS. 8 and 9, the ejecting plunger 202 is connected to elevation 190 by a top plate 203 in the manner shown in FIG. 7. Ejecting plunger 202 moves up and down on ejecting guide rod 194. The ear 191 that holds the opening finger 282 to top plate 203 is similar to the ear that holds or connects to the pivot arm on the mounting plunger. It is connected to the horizontal top plate 203 of the exit plunger 202 in a manner similar to the mounting plunger. Air passages 266 are formed in the bottom of the ejecting plunger 202, to allow for air from the ejection jet 162 to be used to push the completed or processed cap 268 along the exit ramp 121 after the ejecting plunger has pushed the completed cap 268 from the cap receiver, in the indexing table, and down onto the exit ramp 121.

When the completed cap 268 is ejected from the indexing table receptacle, the walls of the cap will relax, so that the diameter at the top of the cap will be greater than the diameter of the receptacle in the indexing table and thereby, will insure that the cap is not picked up by the ejecting plunger as it rises up ejecting guide rod 194. Instead, the completed cap 268 will lie in the bottom of exit ramp 121 and will be urged toward the outlet end of the exit ramp by the action of ejection jet 162.

Further, as shown in FIG. 2, the top of the exit ramp underneath the indexing table, which is in registration with the cap receiving receptacle, is of a diameter that is so small that when the cap with the inserted spout is pushed down by te exit plunger below the indexing table and into the exit ramp, the passage formed by the two halves of the top end of the exit ramp is smaller than the size of the largest diameter that the cap will relax to, so therefore, the cap cannot be brought back up into the indexing table or above the level of the exit ramp by the exit plunger as it returns. This prevents the cap from being skewed between the indexing table and the exit ramp, and being hung up there and jamming the outlet of the machine.

As the cap is urged toward the end of exit ramp 121, the side walls of the inserted pouring spout will extend above the top of the exit ramp and will pass around the closed spout guide 274, which is held over the groove formed in the top of the exit ramp by means of support 276. The exit ramp is mounted to the top of upper platform 50 by means of a series of supports 278.

The closed spout guide 274 extends into the diverging portion of the upper covers of the exit ramp to allow for clearance and access to the caps, in case there is any skewing or misalignment of the caps. Also, the closed spout guide 274 extends down to be flush with the top of the under surface of the top of the exit ramp so that it will provide an adequate guide for the caps as they leave te exit ramp. This deep positioning of the closed spout guide compensates for the shorter wings on the closure portion of the spout.

As can be seen from FIG. 9, there is also a spout clearance slot 280 formed in the bottom of exit ramp 121 to allow for the projecting portions of the spout. The caps, therefore, will be urged by means of ejection jet 162 and outlet jet 164 (not shown in FIG. 8) to the end of exit ramp 121 where they would then be ready for transportation for further processing in an operation which is of no part of this invention.

Figure 10:
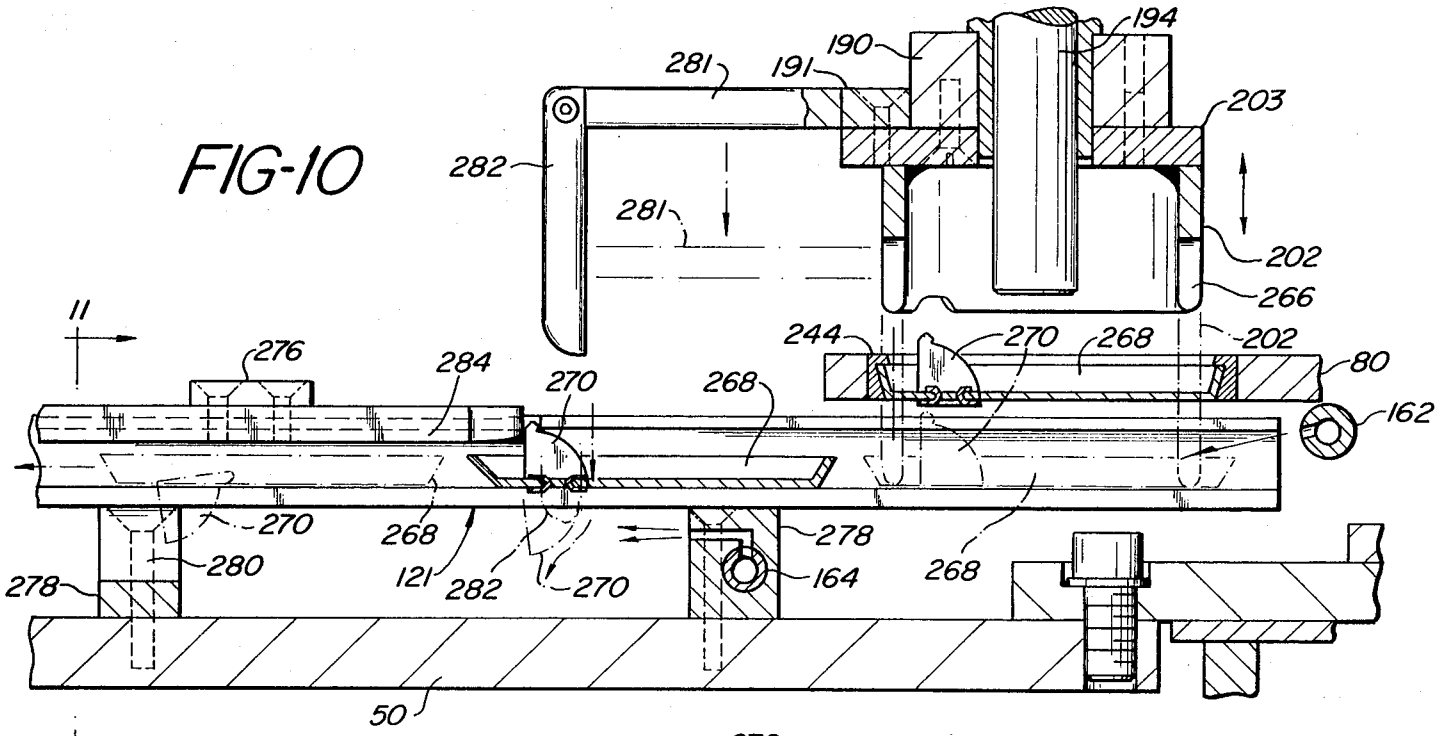
FIG. 10 is a view similar to FIG. 8 showing another embodiment of the outlet section of the machine.
Figure 11:
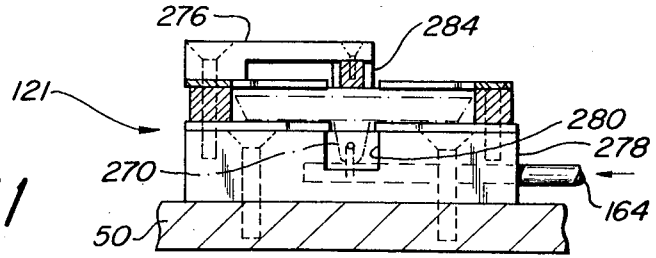
FIG. 11 is a partial front elevation, partially in section, taken along lines 11—11 of FIG. 10.

The embodiment of the invention shown in FIGS. 10 and 11 is adapted to provide the caps with the pouring spouts in the open position, as the caps exit from exit ramp 121. In this configuration, ejecting plunger 202 has a connecting arm 281, which in turn supports an opening finger 282. Connecting arm 281 extends from ear 191 mounted on upper plate 203 of ejecting plunger 202. When the processed cap is ejected by means of ejecting plunger 202 into exit ramp 121, ejection jet 162 will urge the cap toward the end of the ejection ramp until the closed forward end of the spout will abut spout stopper 284. The spout will then be held in this position until the next downward movement of ejecting plunger 202, at which point the opening finger 282 will press against the front or ends of the spout to push the spout to the open position, as shown in the phantom lines.

The cap opening finger 282 extending down from the exit plunger has an elliptically shaped end to give a camming surface on the outlet side of the finger in coaction with the abutting surface of the spout.

When the spout is pushed to the open position, the spout wings will be below the level of spout stopper 284 and the cap will then be urged, under the influence of exit jet 164, to the end of exit ramp 121. The open spout will now be lying in spout clearance slot 280 and the cap with the spout will move to the end of the exit ramp.

It should be noted that under either configuration for delivering the spout, whether that shown in FIG. 8 or that shown in FIG. 10, the cap with the spout will be aligned by means of the spout guide, whether it be the closed spout guide 274 or the open spout clearance slot 280. Therefore, the cap will always leave with the spout in the same position with relation to the exit ramp 121.

As shown in FIG. 11, whether the spout is opened or closed, the spout leaves the ejection plunger in the closed position with the wings raised above the cap and extending upward into the slot at the upper surface of the ejection ramp. This will keep the spout oriented until it reaches the spout stopper where the spout will be opened by the opening finger or if the spout is to remain in the closed position where the wings of the spout will engage the closed spout guide so that the spout will be kept in the proper position and the cap with the spout in the proper position as it goes through the remainder of the exit ramp. This will occur whether the spout is opened or closed. If the spout is closed, then the closed spout guide will guide the spout as it leaves the exit ramp. If the spout is open then the notch or slot in the bottom of the exit ramp through which the spout extends in its open position, will guide the spout as the cap passes through.

The outlet jet 164 is mounted in the exit ramp support 278. If the spout is in the open position then outlet jet 164, located below the bottom of the exit ramp, will catch the open spout like the side of a sail and rapidly propel the cap out. If the spout is in the closed position then the air from discharge nozzle 162, going down the exit ramp, will be sufficient by itself to cause the spout to continue down the ramp guided by the closed spout guide. The outlet jet 164 is necessary if the spout if open because the cap and the spout have been brought to a stop by the spout stopper, and remain stopped until the opening finger presses down the spout to the open position. Then the open spout with the cap must be restarted down the exit ramp and that is the purpose of the outlet jet 164.

From the previous description it should be seen that the invention as presented has several useful features. First, it does not require elaborate means of synchronizing or indexing the transportation of the caps to be processed as they are brought to the machine. They can be brought to the machine under the urging of a simple air jet. Further, as the caps without spouts are fed to the machine, they are fed sequentially in such a way as to prevent any possibility of jamming or having multiple caps jammed into the sequencing operation of the machine. Further, because of the effective synchronization of the caps at the inlet of the machine with the mounting plunger, there is no possibility of the snowballing effect of one stuck cap tending to have an ever increasing effect on the caps waiting to be processed.

The synchronization and gearing provides for rugged, dependable and durable operation. The speeds can easily be controlled by means of changing the speed reducing pulley and by making minor variations in the speed of the speed reducer unit, so that the equipment can provide a wide range of operating speeds. Additionally, variations in the indexing gear box will enable variation of the number of work stations that can be handled by the indexing table.

The sequencing of the outlet operation is also noteworthy in the reliability and simplicity of how it is accomplished. Once again, a minimum of operations are performed on the cap in order to have the cap removed from the indexing table, where the spout inserting process was performed, and moved onward to the end of the exit ramp.

It will be understood that various changes in the details, materials, and arrangement of parts which have been herein described and illustrated in order to explain the nature of the invention, may be made by those skilled in the art within the principal and scope of the invention as expressed in the appended claims.

It should be noted that by changing the polarity of the motor, it is possible to reverse the direction of the indexing table so that it goes in the opposite direction. Similarly, because of the symmetry of design it is possible to change the inlet and outlet stations of the apparatus.

What is claimed is:

1. A machine for inserting pouring spouts into container tops comprising:

inlet means to bring a supply of caps for processing;

exit means to allow passage from the apparatus of caps with inserted spouts;

spout inserting means;

indexing means to carry the tops from the inlet means to the spout inserting means and then to the exit means;

said indexing means including receptacle means in said indexing means to receive and secure the tops mounted in the indexing means;

mounting means to mount the tops in the indexing means;

ejecting means to eject the tops with inserted spouts from the receptacle of the indexing means;

means to sequentially feed caps to said mounting means;

said indexing means comprising an indexing table;

said inlet means comprising an inlet ramp;

said exit means comprising an exit ramp;

said drive means comprising a drive and power transmission means;

access means in said exit ramp comprising;

a separate segment including a top and side wall;

pivot means connecting said separate segment to said exit ramp;

holding means to hold said separate segment in proper relation to said exit ramp; and fixing means to fix said segment to said holding means.

2. A machine for inserting pouring spouts into container tops comprising:

inlet means to bring a supply of caps for processing;

exit means to allow passage from the apparatus of caps with inserted spouts;

spout inserting means;

indexing means to carry the tops from the inlet means to the spout inserting means and then to the exit means;

mounting means to mount the tops in the indexing means;

ejecting means to eject the tops with inserted spouts from the indexing means;

means to sequentially feed caps to said mounting means; means to stabilize and align said container tops while awaiting action by said mounting means;

means to stabilize said container tops in said indexing means;

wherein the means to stabilize said container tops in said index means comprise:

wherein the means to stabilize said container tops in said index means comprise:

a stabilizing plate disposed beneath said indexing means; and said stabilizing plate having a surface substantially parallel to the surface of said indexing means so that caps mounted in said indexing means can not extend substantially below the bottom surface of said indexing means.

3. A machine for inserting pouring spouts into container tops according to claim 2 wherein said means to stabilize said container tops in said indexing means further comprise:

cap receiver means in said indexing means having tapered sidewalls and an overhanging lip in said upper portion to allow relaxation of the sidewalls of said cap and to prevent upward movement of said cap in said cap receiver.

4. A machine for inserting pouring spouts into container tops comprising:

inlet means to bring a supply of caps for processing;

exit means to allow passage from the apparatus of caps with inserted spouts;

spout inserting means;

indexing means to carry the tops from the inlet means to the spout inserting means and then to the exit means;

mounting means to mount the tops in the indexing means; ejecting means to eject the tops with inserted spouts from the indexing means;

means to sequentially feed caps to said mounting means;

spout positioning means to position the spout with relation to the container top;

cap orienting means to orient the position of the cap with relation to the exit means;

means to stabilize and align said container tops while awaiting action by said mounting means;

means to stabilize said container tops in said indexing means;

means to actuate said mounting means, said spout inserting means, and said ejection means;

coordinating means between said mounting means, said ejecting means, and said spout inserting means to insure coordinated operation of said mounting means, said ejecting means, and said spouting inserting means with said indexing means;

means to urge said container tops to said mounting means; and means to urge said container tops with inserted spouts along said exit means;

access means in said exit ramp comprising:

a separate segment including a top and side wall;

pivot means connecting said separate segment to said exit ramp;

holding means to hold said separate segment in proper relation to said exit ramp; and fixing means to fix said segment to said holding means.

5. A machine for inserting pouring spouts into container tops according to claim 4 wherein:

said means to urge said container tops to said mounting means and to urge said tops with inserted spouts along said exit means comprise:

air jet means disposed in said inlet means and said exit means;

said indexing means comprise an indexing table;

said inlet means comprise an inlet ramp;

said exit means comprise an exit ramp;

said drive means comprise a drive and power transmission means;

said mounting means comprise:

a mounting plunger and stripping fingers in said inlet means adapted to coact with said mounting plunger to prevent caps which are mounted in said indexing means from being withdrawn by said mounting means;

wherein said ejecting means comprise:

an ejecting plunger;

air passages in said plunger to facilitate urging of said ejected caps along said said exit means;

air jet means operatively associated with said exit means and said ejecting means to urge said caps along said exit means;

wherein the means to sequentially feed caps to said mounting means comprise:

a mounting plunger;

a timing finger;

arm means connecting said timing finger to said mounting plunger; and means to pivotally mount said arm to said mounting plunger to actuate said timing finger in opposition to movement of said mounting plunger;

wherein said spout positioning means comprise:

closed spout guide means connected to said exit means;

slot means on the bottom of said exit means;

wherein said spout positioning means comprise:

a spout stopper disposed in said exit means;

an ejecting plunger;

an opening finger connected to said ejecting plunger to open said spouts in said exit means abutting said spout stopper;

wherein said cap orienting means comprise:

an exit slot disposed in the bottom of said exit means in which said pouring spout will be held as the cap travels along said exit means;

wherein said means to stabilize and align said tops while awaiting action by said mounting means comprise:

a waiting plate disposed at the end of said inlet means;

said waiting plate comprising:

a backup stop;

a receptacle for caps awaiting actuation by said mounting means;

wherein said means to stabilize and align said tops while awaiting action by said mounting means further comprise:

a camming surface in said inlet means adapted to position said empty tops into said receptacle in said waiting plate;

wherein the means to stabilize said container tops in said index means comprise:

a stabilizing plate disposed beneath said indexing means;

said stabilizing plate having a surface substantially parallel to the surface of said indexing means so that caps mounted in said indexing means can not extend substantially below the bottom surface of said indexing means;

wherein said means to stabilize said container tops in said indexing means further comprise:

cap receiver means in said indexing means having tapered sidewalls and an overhanging lip in said upper portion to allow relaxation of the sidewalls of said cap and to prevent upward movement of said cap in said cap receiver;

wherein said means to actuate said mounting means, said spouting inserting means, and said ejecting means comprise:

cam means connected to said drive means;

elevator means operatively coacting with said cam means to raise and lower in accordance with the position of said cam means;

said elevator means connected with said mounting means, said ejecting means, and said spout inserting means;

wherein said coordinating means between said mounting means, said ejecting means, and said spout inserting means further comprise:

power transmission means between said drive means and said cam means including:

drive shafts for said cam means;

gear means coordinating location of said drive shaft means;

chain means driving said gear means and connecting with said drive.

* * * * *